US006752598B2

(12) United States Patent
Antunes et al.

(10) Patent No.: US 6,752,598 B2
(45) Date of Patent: Jun. 22, 2004

(54) DEVICE FOR IMMOBILIZING BLADES IN A SLOT OF A DISK

(75) Inventors: Bruno Antunes, Fontenay sous Bois (FR); Jean-Pierre Paul Henri Caubet, Dammarie-les-Lys (FR); Alain Jean Charles Chatel, Melun (FR); Laurernt Dezouche, Le Coudray Montceau (FR); Nicolas Smirr, Maincy (FR)

(73) Assignee: SNECMA Moteurs, Paris (FR)

( * ) Notice: Subject to any disclaimer, the term of this patent is extended or adjusted under 35 U.S.C. 154(b) by 62 days.

(21) Appl. No.: 10/300,815

(22) Filed: Nov. 21, 2002

(65) Prior Publication Data

US 2003/0123986 A1 Jul. 3, 2003

(30) Foreign Application Priority Data

Nov. 22, 2001 (FR) ..... 01 15095

(51) Int. Cl.[7] ..... F01D 5/30
(52) U.S. Cl. ..... 416/215; 416/220 R
(58) Field of Search ..... 416/220 R, 215, 416/219 R, 217, 218; 411/84, 85

(56) References Cited

U.S. PATENT DOCUMENTS 3,088,708 A 5/1963 Feinberg
3,955,898 A 5/1976 Zaehring
H1258 H 12/1993 Hindle, Jr.
6,464,463 B2 * 10/2002 Goga et al. ..... 416/215

FOREIGN PATENT DOCUMENTS

| | | |
|---|---|---|
| FR | 1402507 | 7/1964 |
| GB | 659592 | 10/1951 |
| GB | 2 156 908 A | 10/1985 |

* cited by examiner

*Primary Examiner*—Edward K. Look
*Assistant Examiner*—Kimya N McCoy
(74) *Attorney, Agent, or Firm*—Oblon, Spivak, McClelland, Maier & Neustadt, P.C.

(57) ABSTRACT

The invention relates to a device for immobilizing blades in the peripheral slot of a turbomachine disk. Said blades comprise roots of the hammer head type adapted to be introduced into said slot through a loading window and held in said slot by collaboration of shape with the sidewalls thereof. Said immobilizing device is adapted to be introduced into said slot through said loading window and comprises a locking element arranged in a space separating two adjacent blade roots. Said locking element is adapted to be raised up into a lock housing formed in the sidewalls of said slot under the action of a radial manipulating screw the head of which rests against the bottom of the slot, a radial clearance being provided between the bottom of the slot and the underside of the blade roots, and said screw head being restrained in a radially outward direction by said two adjacent blade roots.

7 Claims, 7 Drawing Sheets

DEVICE FOR IMMOBILIZING BLADES IN A SLOT OF A DISK

BACKGROUND OF THE INVENTION

The invention relates to a turbomachine disk comprising a peripheral slot having sidewalls and a loading window, and a plurality of blades retained in said peripheral slot, said blades comprising roots of the hammer head type adapted to be introduced into said slot through said loading window and to be held in said slot by collaboration of shape with said sidewalls, a radial clearance being provided between the bottom of said slot and the underside of said blade roots, in which there is provided a device for immobilizing said blades in said peripheral slot, said immobilizing device adapted to be introduced into said slot through said loading window and comprising a locking element and a radial manipulating screw having a head, said locking element adapted to be arranged in a space separating two adjacent blade roots and to be raised up, under the action of said manipulating screw, into a lock housing formed in said sidewalls, said screw head resting against the bottom of said slot.

Several locking devices of this type may be provided per stage. In general, the screw head, which is wider than the screw shaft, is housed in a recess formed in the bottom of the slot in line with the corresponding lock housing. Because the screw head is wider than the shaft, the screw is rendered captive. In current constructions, the locking element consists of a protrusion formed on the upper face of a body which, in a locking position of the device, rests against the sidewalls of the slot near the neck of the slot. This body has a lower base which, when the device is in the locking position, is spaced from the screw head so as to allow said body to slide in the slot when the blades are being mounted. Indeed, in order to allow this sliding, the protrusion formed on the body has to lie in the slot. The base of the body then rests against the screw head and lies near the bottom of the slot.

When the device is positioned facing the lock housing, by rotating all the blades about the disk, the body is raised up toward the outside under the action of the manipulating screw using a key that fits onto the opposite end of the screw to the head and is positioned in an orifice made in the platforms of the two adjacent blades. The protrusion is held in the lock housing by bracing between, on the one hand, the lock body resting in the neck of the disk and, on the other hand, the screw head housed in a recess formed in the bottom of the slot. The way the system works is dependent on the local deformation or by an attached thread or by any other means.

If the bracing effect is lost, only the self-locking effect retains the screw and prevents the protrusion from escaping from the lock housing.

By construction, the one-piece part consisting of the body and of its protrusion has no positive guide means as it slides in the slot during mounting. The screw head may therefore be incorrectly positioned in its recess during tightening, and this may result in subsequent movement of the screw head during operation of the turbomachine and a loss of the bracing effect. The tightening of an incorrectly positioned screw may also lead to seizure of the screw thread. Whereas this may hold the protrusion in the lock housing, this subsequently leads to difficulties in dismantling the device for maintenance operations.

Furthermore, during operation of the turbomachine, the screw is subjected to considerable centrifugal forces which, if the bracing effect is lost, may cause the screw to turn and therefore come out into the gas stream. This may, ultimately, release the protrusion from the lock housing when the turbomachine stops. from the lock housing when the turbomachine stops.

In another known immobilizing device, the locking element is mounted to slide axially in a radial opening of a body having a cross section tailored to the cross section of the slot and immobilized radially, and the screw head is trapped between the bottom of the slot and the base of the body. Means are provided for limiting the extent to which the locking element is raised up.

Thus, the body is guided as it slides in the slot, and this gives the axis of the screw a precise radial direction and avoids seizure. Furthermore, the screw head is radially immobilized with respect to the body, and the action of the centrifugal forces on the locking element, should the screw become partially slackened, prevents this screw from turning, because the screw head is then resting positively against the base of the body. The body is arranged between the roots of a pair of blades. It has a lower base situated above the bottom of the slot and a radial through-opening of noncircular cross section in which the locking element is slideably mounted under the action of the manipulating screw. The screw head is dimensioned to remain trapped between the bottom of the slot and the base of the body.

The cross section of the body in a plane perpendicular to the axis of the manipulating screw is greater than the cross section of the locking element in the same plane, and the cross section of the screw head is also greater than the cross section of the locking element so that the upper face of the screw head is adapted to bear against the base of the body. This technology is not suited to certain turbine disks because there is not enough room between the roots of two consecutive blades.

SUMMARY OF THE INVENTION

The object of the invention is to propose an immobilizing device which overcomes these disadvantages and which can be housed in a small circumferential space.

This object is achieved through the fact that said screw head is restrained in the radially outward direction by the two adjacent blade roots.

Thus, should the screw become slack during operation, under the action of centrifugal force, the outward between the bottom of the slot and the underside of the blade roots. When the screw head is resting positively against the blade roots, the same centrifugal forces acting on the locking element push the latter outward, and this prevents greater tightening of the screw and might even tend to cause it to turn in the opposite direction.

According to a simplified first embodiment, the diameter of the screw head is greater than the separation between said two adjacent blade roots. The immobilizing device therefore comprises two parts: the locking element and the manipulating screw.

According to a second embodiment of the invention, there is further provided an intermediate plate between said screw head and said locking element, the ends of said plate being arranged under said two adjacent blade roots.

According to another advantageous feature of the invention, said plate comprises means for preventing it from turning with respect to said locking element. These means consist, for example, of radial tabs which allow the locking element to be raised up during mounting.

Advantageously, the plate also comprises means for preventing the screw head from turning. These means preferably consist of radial tabs resting on flats of the screw head. These tabs are flexible so as to allow the screw to turn, during mounting, as the locking element is raised up.

According to another feature of the invention, the locking element has an upper protrusion or sleeve near the end of the screw which can be housed in an orifice made in the platforms of said two adjacent blades. This sleeve acts as a visual indicator that the locking indicator has been raised up.

DESCRIPTION OF THE PREFERRED EMBODIMENTS

Figure 3:
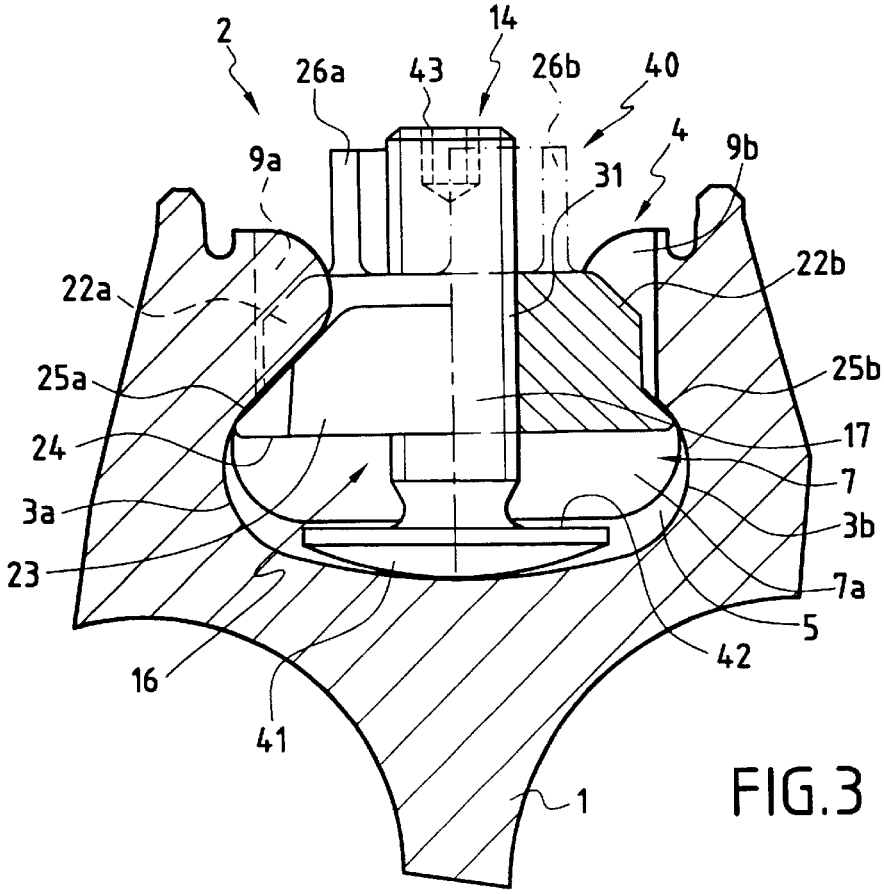
FIG. 3 is a view in section on III—III of FIG. 2 showing an immobilizing device according to a first embodiment of the invention, this section being taken on a radial plane passing through the axis of the turbomachine, the blades being omitted for clarity; turbomachine, the blades being omitted for clarity.

FIG. 3 shows, in radial section, a turbomachine impeller disk 1 which at its periphery has a slot 2 intended to hold the blade roots of the hammer head type. This slot 2, delimited by sidewalls 3*a* and 3*b* of curved cross section, opens to the outside via a neck 4 which, in the direction of the axis of rotation of the impeller, has a dimension smaller than the dimension of a cavity 5 formed in the bottom of the slot 2. The blade roots have a cross section in the radial plane passing through the axis of rotation of the disk 1 that is tailored to the cross section of the slot 2 so that they can be held therein by collaboration of shape.

Figure 1:
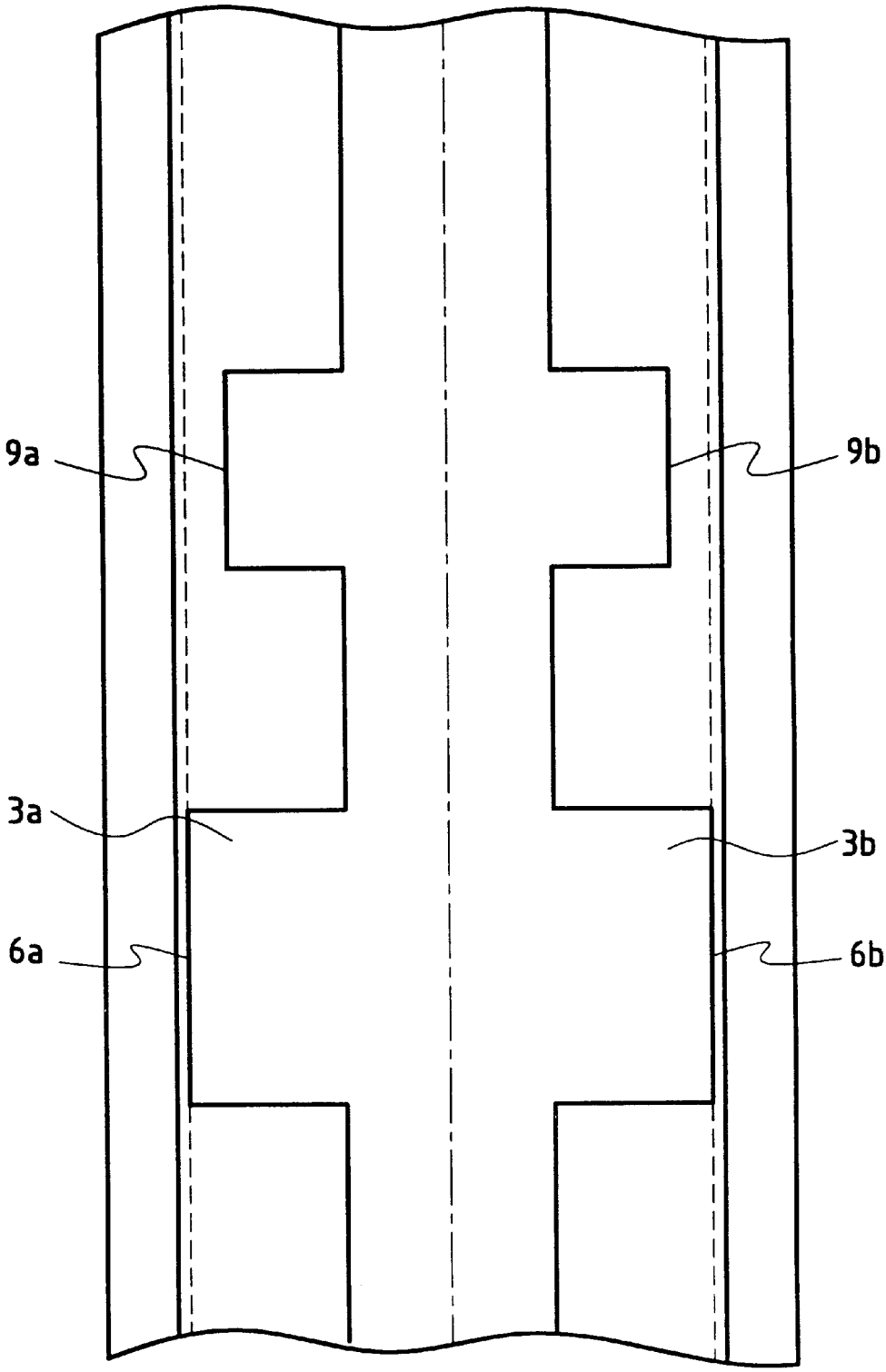
FIG. 1 is a plan view of a portion of an impeller disk not equipped with blades.

FIG. 1 is a view from above of a portion of the disk 1. As can be seen in this FIG. 1, the sidewalls 3*a* and 3*b* comprise, facing each other, a first pair of radial cut-outs 6*a* and 6*b* which constitute a loading window, allowing the roots 7 of the blades 8 to be introduced into the slot 2 when these blades 8 are mounted, and a second pair of radial cut-outs 9*a*, 9*b* which constitute a housing for the lock of a blade-immobilizing device that is the subject of the invention. The second pair of cut-outs 9*a*, 9*b* is angularly offset from the first pair of cut-outs 6*a*, 6*b* by a distance equal to the angle formed by two adjacent blades or to a multiple of this angle.

It should be noted that the same impeller disk 1 may have several locking devices according to the invention.

Figure 2:
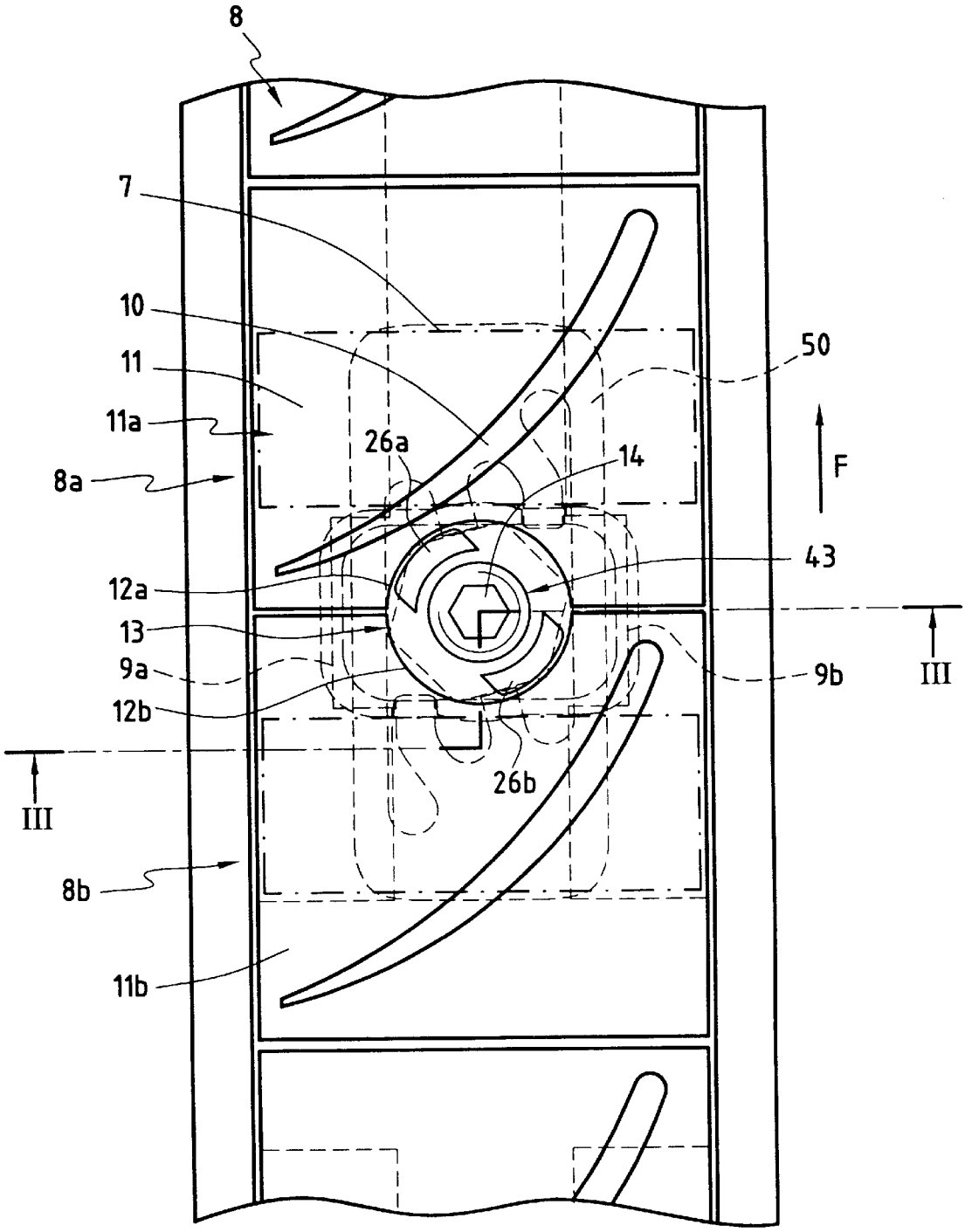
FIG. 2 corresponds to FIG. 1 but shows the impeller disk equipped with hammer head blades immobilized by a locking element according to the invention.

FIG. 2 shows the same portion of the disk 1 equipped with blades 8. Each blade 8 comprises, between its root 7 and its aerodynamic portion 10, a platform 11 which covers the periphery of the disk 1. The platforms 11 covers the periphery of the disk 1. The platforms 11 of the blades 8 internally delimit a duct in which gases flow through the turbomachine.

All the blades 8 are mounted on the disk 1 in the same way. The root 7 of each blade 8 is introduced, in turn, into the slot 2 through the window formed by the first pair of cut-outs 6*a*, 6*b*, and the blade 8 is slid in the direction of the arrow F until its platform 11 butts against the platform of the blade introduced previously.

All the blades 8 are identical except for the penultimate one mounted, referenced 8*a*, and for the last one mounted, referenced 8*b*, which on the adjacent edges of their platforms 11*a* and 11*b* have notches 12*a* and 12*b* which together constitute an orifice 13, the function of which will be explained later on in this description.

After introducing the penultimate blade 8*a* into the slot 2, an immobilizing device 14 is introduced through the loading window into the slot 2, then the root 7 of the last blade is positioned in the loading window between the penultimate blade 8*a* and the first blade mounted, and all the blades 8 are slid together in the half the magnitude of the angle between two adjacent blades, so that the platforms 11*a* and 11*b* of the penultimate blade mounted 8*a* and of the last blade mounted 8*b* are contiguous along the mid-plane of the loading window formed by the first pair of cut-outs 6*a* and 6*b*. In this position, the immobilizing device 14 arranged between the roots 7 of the blades 8*a* and 8*b* lies facing the second pair of cut-outs 9*a* and 9*b*.

The cut-outs 9*a* and 9*b* have axial and peripheral dimensions smaller than those of the cut-outs 6*a* and 6*b* of the window for loading the blades 8, so as to prevent the blades 8 from escaping as they travel past these cut-outs 9*a* and 9*b*.

It should be noted that there is a clearance between the underside 15 of the roots 7 of the blades and the bottom of the slot 2.

Figure 4:
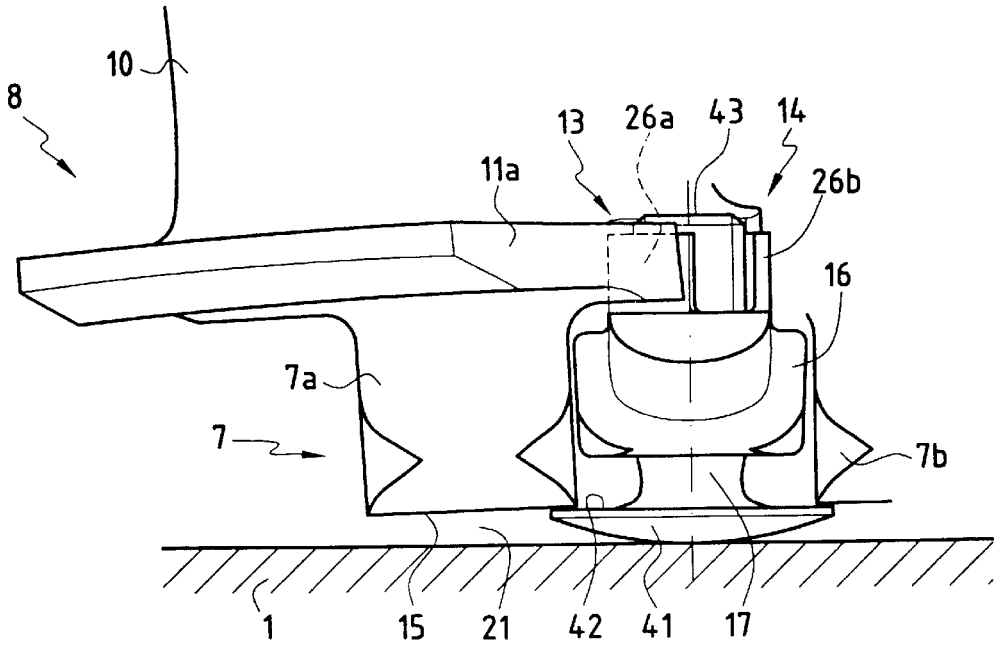
FIG. 4 is an axial view showing the immobilizing device of FIG. 3 between two blade roots.
Figure 5:
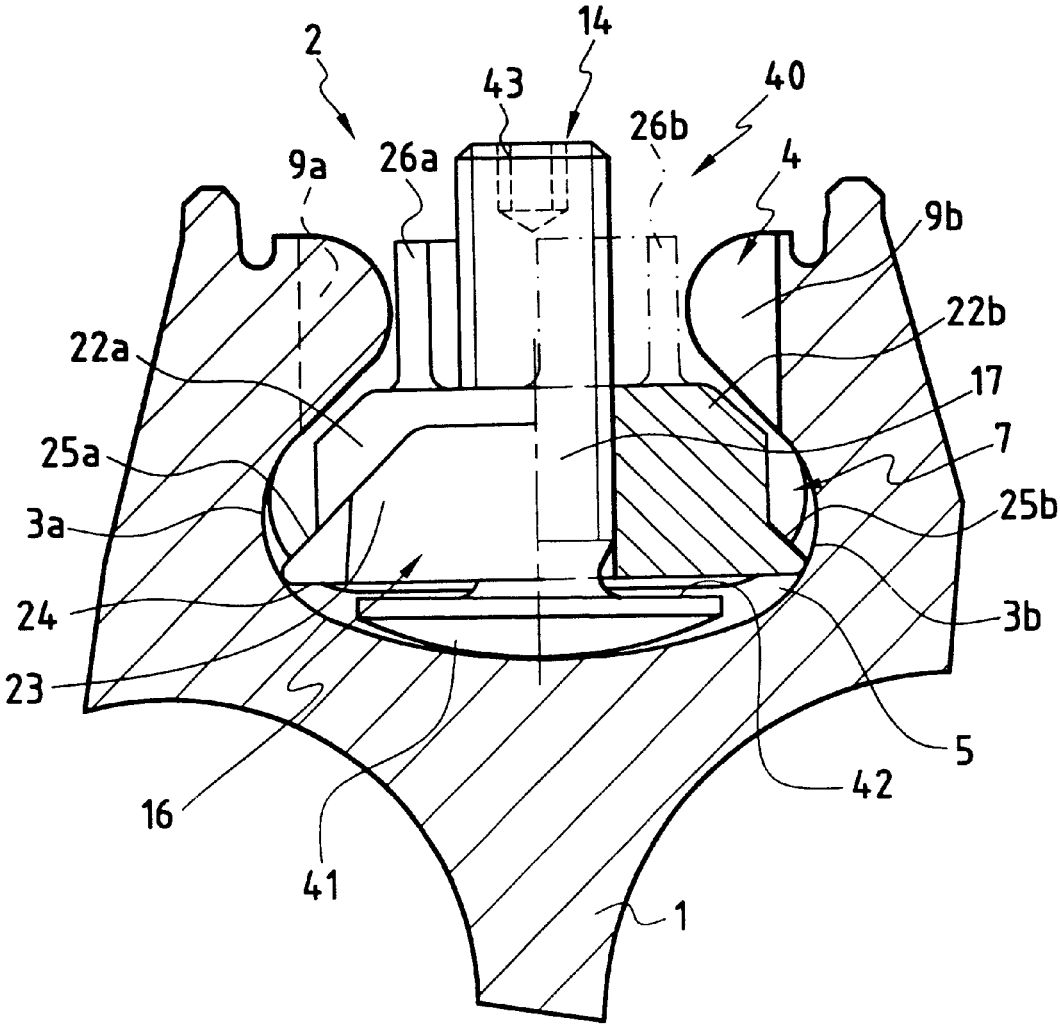
FIG. 5 corresponds to FIG. 3, but showing the locking element in a lowered position.
Figure 6:
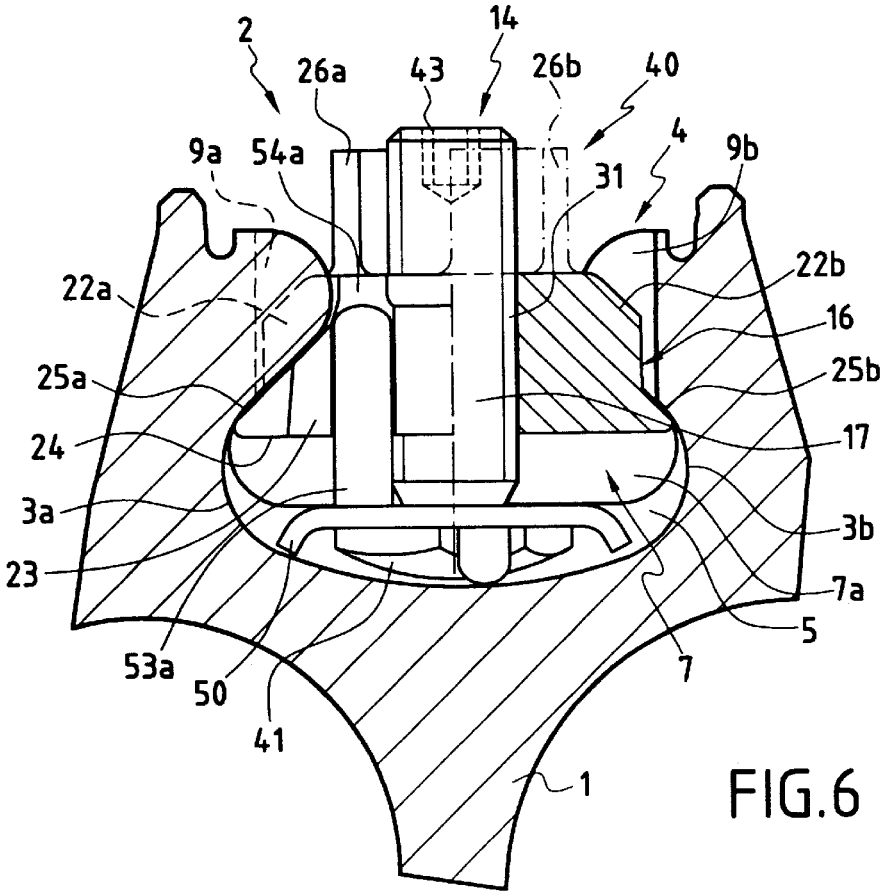
FIGS. 6, 7 and 8 correspond respectively to FIGS. 3, 4 and 5 but show an immobilizing device according to a second embodiment of the invention which includes an intermediate plate.
Figure 7:
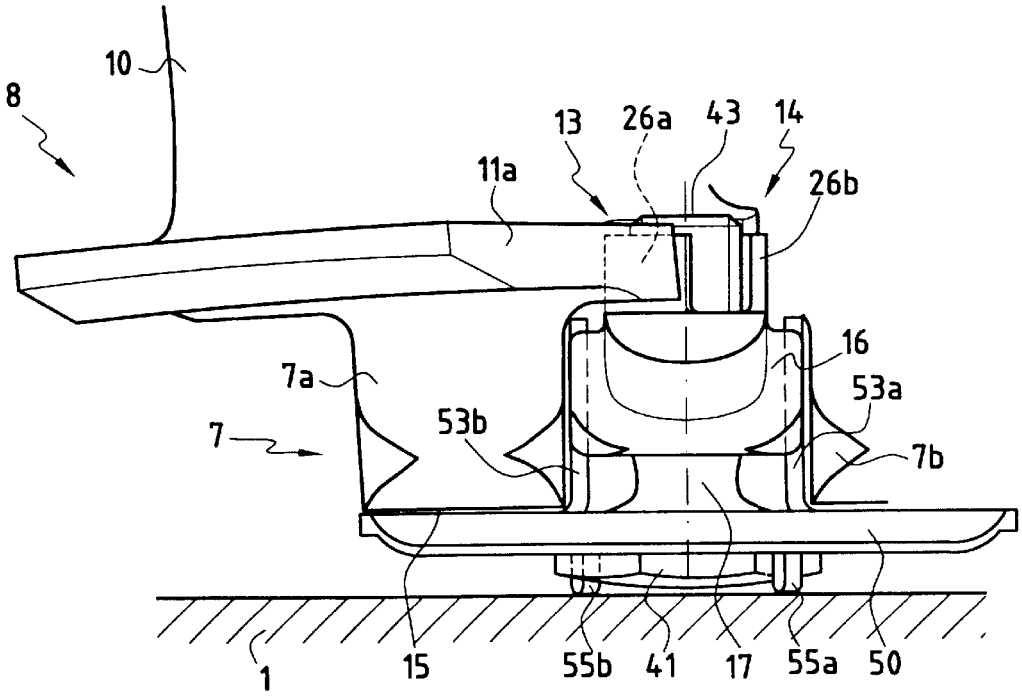
Figure 8:
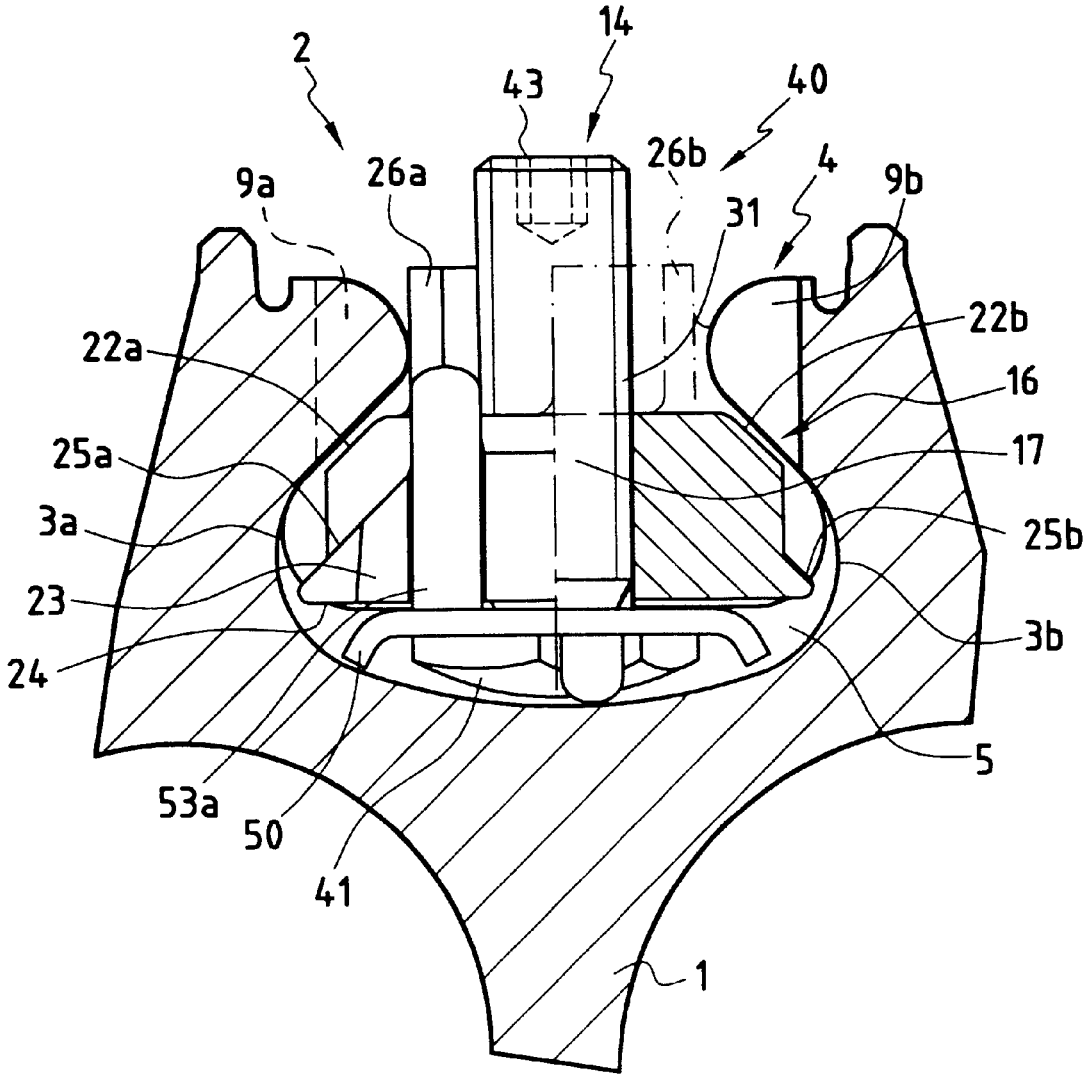

FIGS. 3 to 5 show a first embodiment of the immobilizing device 14 which consists of two parts, namely a locking element 16 and a manipulating screw 17.

The locking element 16 has a cross section, in a radial plane passing through the axis of rotation of the disk 1, which is designed in such a way that the locking element 16 can slide in the slot 2 during mounting. It has a radial bore tapped with a screw thread 31 adapted to co-operate with a screw thread on the shaft 40 of the manipulating screw 17. The manipulating screw 17 has a screw head 41 of large size which is housed in an annular space 21 delimited by the underside 15 of the blade roots 7 and the bottom of the slot 2. The diameter of this head 41 is greater than the distance separating the two adjacent blade roots 7*a* and 7*b*, as can be seen in FIG. 4. A peripheral portion of the upper face 42 of the screw head 41 can therefore rest against the underside 15 of these two blade roots 7*a* and 7*b*, and thus limit the possible radial displacement of the screw head 41. The end 43 of the manipulating screw 17 that is the opposite end to the screw head 41, is housed in the orifice 13 formed by the notches 12*a* and 12*b* of the platforms 11*a* and 11*b*. This end 43 is equipped with means adapted for co-operation with a tightening key, for example of the Allen key type, so that the locking element 16 is able to be raised radially outward when it is positioned facing the second pair of cut-outs 9*a* and 9*b* by means of relative angular movement between the screw 17 and the locking element 16.

The circumferential dimension of the cut-outs 9*a* and 9*b* is advantageously smaller than the distance separating the two adjacent blade roots 7*a* and 7*b*. The circumferential dimension of the base 23 of the locking element 16 is substantially equal to or smaller than the distance separating the two adjacent blade roots 7*a* and 7*b*, while the circumferential dimension of the upper portion of the locking element is substantially equal to the circumferential dimension of the cut-outs 9*a* and 9*b*, at least in the region of portions 22*a* and 22*b* which are housed in these cut-outs 9*a* and 9*b* after the locking element 16 has been raised up.

As shown in FIG. 5, the portions 22*a* and 22*b* are arranged in the cavity 5 of the slot 2 when the locking element is in a lowered position. The same is true of the base 23 of the locking element 16, the lower face 24 of which is then only a small distance above the upper face 42 of the screw head.

When the locking element 16 is raised up by turning the manipulating screw 17, as shown in FIG. 3, the lower face 24 of the locking element 16 is moved away from the screw head. The sidewalls 25*a* and 25*b* of the base 23 therefore rest against the sidewalls 3*a* and 3*b* of the slot 2 near the cut-outs 9*a* and 9*b*.

When the turbomachine is in operation, the centrifugal forces exerted on the locking element 16 have a tendency to push the latter and the manipulating screw back outward. The sidewalls 25*a* and 25*b* of the base 23 therefore rest positively against the sidewalls 3*a* and 3*b* of the slot 2, and if the manipulating screw 17 becomes slackened, the displacement of the screw head 41 will be limited because the peripheral portion of the screw head 17 is retained by the adjacent blade roots 7*a* and 7*b*. When the disk 1 stops, the screw head 17 will be able to rest against the bottom of the slot 2, but the portions 22*a* and 22*b* of the locking element 16 will remain captive in the cut-outs 9*a* and 9*b*.

References 26*a* and 26*b* denote radial protrusions parallel to the axis of the manipulating screw 17 and which extend radially outward above the upper portion of the locking element 16. The tops of these protrusions 26*a*, 26*b* are arranged in the orifice 13 of the platforms 11*a* and 11*b* when the locking element 16 is raised up, so as to serve as a visual indicator that the locking element 16 has been raised up correctly, during mounting, or during servicing inspections.

The first embodiment of the invention described hereinabove requires that the diameter of the screw head 41 be greater than the separation between the two adjacent blade roots 7*a* and 7*b*. This demands that the axial dimension of the underside 15 of a blade root be greater than the distance separating the two adjacent blade roots 7*a* and 7*b*.

FIGS. 6 to 12 show a second embodiment of the invention which can be applied to any type of bladed disk of the hammer head type.

In the second embodiment of the invention, the locking element 16 is almost the same as the one described hereinabove and will not be described further. Only the optional variations will be described.

The manipulating screw 17 according to the second embodiment of the invention has a screw head 41 of small, preferably noncircular diameter. This diameter is, for example, smaller than the distance separating the two adjacent blade roots 7*a* and 7*b*.

To limit the possible radial displacement of the screw head 41, an intermediate plate 50 is inserted between the screw head 41 and the locking element 16. This intermediate plate 50, which has an oblong shape, has a central orifice 51 through which the shaft 40 of the manipulating screw 17 passes and its circumferential dimension is such that its ends 52*a* and 52*b* are arranged under the two adjacent blade roots 7*a* and 7*b*. Thus, if the screw should work loose during operation of the turbomachine, the upper face 42 of the screw head 17 comes to rest on the lower face of the intermediate plate 50, the ends 52*a* and 52*b* of which rest against the undersides 15 of the two adjacent blade roots, thus limiting the radial displacement of the screw head 41.

Figure 9:
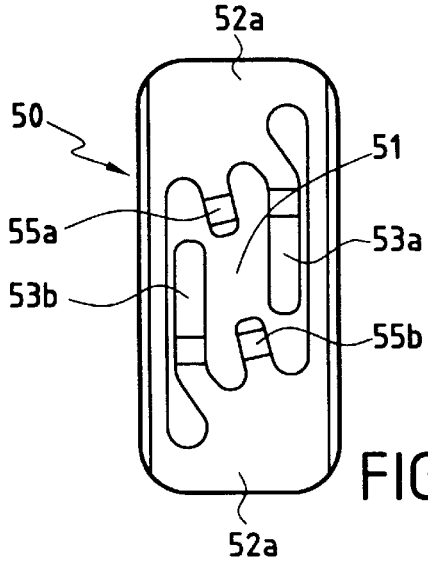
FIG. 9 shows the intermediate plate used in the second embodiment in a raw state.
Figure 11:
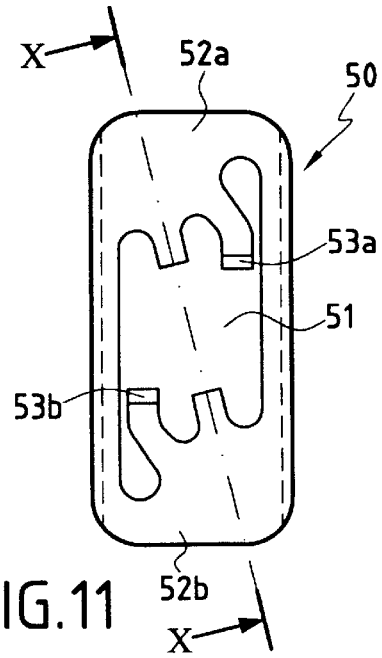
FIG. 11 is a plan view of the intermediate plate as configured in use.
Figure 10:
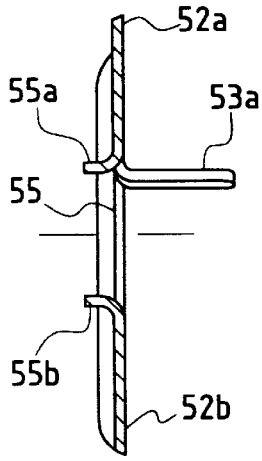
FIG. 10 is a section of the intermediate plate on X—X of FIG. 11.
Figure 12:
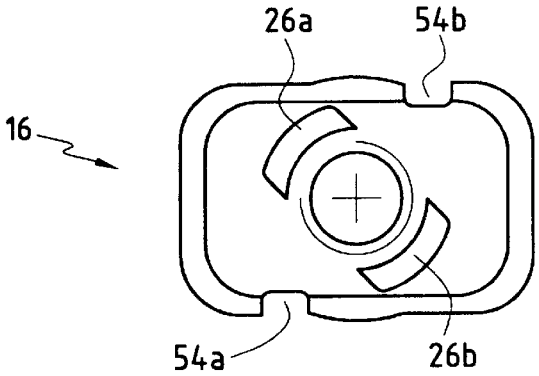
FIG. 12 is a plan view of the locking element according to the second embodiment of the invention.

Advantageously, the intermediate plate 50, which is preferably made from sheet metal by cutting and bending, and which is shown in detail in FIGS. 9 to 11, comprises two radial tabs 53*a* and 53*b* which extend outward and which are housed in radial slots 54*a* and 54*b* formed on two opposed faces of the locking element 16, as shown in FIG. 12. The collaboration of the tabs 53*a* and 53*b* with the slots 54*a* and 54*b* prevents the intermediate plate 50 from turning with respect to the locking element 16, while at the same time allowing the locking element 16 to slide with respect to the intermediate plate 50 as the locking element is raised or lowered. The slots 54*a* and 54*b* are preferably formed on the faces of the locking element 16 which face the adjacent faces of the two blade roots 7*a* and 7*b*.

The intermediate plate 50 also and preferably comprises two resilient tabs 55*a* and 55*b* which extend radially inward and which are intended to prevent the manipulating screw 17 from working loose, the head 41 of this screw then comprising flats, for example six of these, against which the tabs 55*a* and 55*b* rest.

The elasticity of the tabs 55*a* and 55*b* is calculated so as to allow the screw head 17 to turn when a predetermined torque is exerted on the end 43 of the manipulating screw 17, as the locking element 16 is raised or lowered, and to prevent the screw head 17 from turning when this torque is not present.

FIG. 9 shows the intermediate plate 50, in a raw state, before the tabs 53*a*, 53*b*, 55*a* and 55*b* are bent up. Notice that the orifice 51 is not circular.

The intermediate plate 50 is centred with respect to the manipulating screw 17 by collaboration of the tabs 53*a* and 53*b* with the slots 54*a* and 54*b* of the locking element 16. However, the orifice 51 is dimensioned in such a way that the screw head 41 rests against the lower face 55 of the intermediate plate 50.

Note that the locking element 16 according to the first embodiment of the invention does not need the radial slots 54*a* and 54*b* described hereinabove, which serve to prevent the intermediate plate 50 from turning.

However, the same type of locking element with radial slots 54*a* and 54*b* can be used in both embodiments of the invention. Only the geometry of the space accommodating the screw head 41 needs to be considered when choosing the preferred embodiment of the invention.

We claim:

1. In a turbomachine disk comprising a peripheral slot having sidewalls and a loading window, and a plurality of blades retained in said peripheral slot, said blades comprising roots of the hammer head type adapted to be introduced into said slot through said loading window and to be held in said slot by collaboration of shape with said sidewalls, a radial clearance being provided between the bottom of said slot and the underside of said blade roots, there is provided a device for immobilizing said blades in said peripheral slot, said immobilizing device adapted to be introduced into said slot through said loading window and comprising a locking element and a radial manipulating screw having a head, said locking element adapted to be arranged in a space separating two adjacent blade roots and to be raised up, under the action of said manipulating screw, into a lock housing formed in said sidewalls, said screw head resting against the bottom of said slot and being restrained in the radially outward direction by said two adjacent blade roots.

2. A device as claimed in claim 1, wherein the diameter of said screw head is greater than the separation between said two blade roots.

3. A device as claimed in claim 1, wherein there is further provided an intermediate plate between said screw head and said locking element, the ends of said plate being arranged under said two adjacent blade roots.

4. A device as claimed in claim 3, wherein said plate comprises means for preventing it from turning with respect to said locking element.

5. A device as claimed in claim 4, wherein said means consist of radial tabs.

6. A device as claimed in claim 3, wherein said plate comprises means for preventing said screw head from turning.

7. A device as claimed in claim 6, wherein said screw heads includes flats, and said means comprise radial tabs resting against said flats.

* * * * *

UNITED STATES PATENT AND TRADEMARK OFFICE

CERTIFICATE OF CORRECTION

PATENT NO. : 6,752,598 B2
DATED : June 22, 2004
INVENTOR(S) : Bruno Antunes et al.

It is certified that error appears in the above-identified patent and that said Letters Patent is hereby corrected as shown below:

Column 2,
Lines 4-5, delete "from the lock housing when the turbomachine stops."

Column 3,
Lines 23-24, delete "turbomachine, the blades being omitted for clarity."

Column 6,
Line 40, change "centred" to -- centered --.

Signed and Sealed this

Ninth Day of November, 2004

JON W. DUDAS
*Director of the United States Patent and Trademark Office*